US006463699B1

(12) United States Patent
Bailey et al.

(10) Patent No.: US 6,463,699 B1
(45) Date of Patent: Oct. 15, 2002

(54) AIR BEAM CONSTRUCTION USING DIFFERENTIAL PRESSURE CHAMBERS

(75) Inventors: Gary L. Bailey, San Antonio; Ross S. Woods, Grand Prairie, both of TX (US)

(73) Assignee: OBI Corporation, San Antonio, TX (US)

( * ) Notice: Subject to any disclaimer, the term of this patent is extended or adjusted under 35 U.S.C. 154(b) by 0 days.

(21) Appl. No.: 09/815,512

(22) Filed: Mar. 23, 2001

(51) Int. Cl.[7] ..... E04H 15/20; F16L 11/00; F16L 9/18

(52) U.S. Cl. ..... 52/2.11; 52/2.13; 52/2.18; 138/115

(58) Field of Search ..... 521/2.11, 2.13, 521/2.18, 2.22, 2.23, 729.1; 138/115, 116, 117, 176, 177

(56) References Cited

U.S. PATENT DOCUMENTS

| | | | | |
|---|---|---|---|---|
| 4,146,996 | A | | 4/1979 | Arnesen |
| 4,183,378 | A | | 1/1980 | Decker |
| 4,288,947 | A | | 9/1981 | Huang |
| 5,311,706 | A | | 5/1994 | Sallee |
| 5,353,559 | A | * | 10/1994 | Murota |
| 5,393,598 | A | * | 2/1995 | Schlecker |
| 5,421,128 | A | * | 6/1995 | Sharpless |
| 5,546,707 | A | * | 8/1996 | Caruso |
| 5,579,609 | A | | 12/1996 | Sallee |
| 5,677,023 | A | | 10/1997 | Brown |
| 5,735,083 | A | | 4/1998 | Brown et al. |
| 5,875,868 | A | * | 3/1999 | Smialowicz |
| 5,913,775 | A | * | 6/1999 | Delamare |
| 6,108,980 | A | * | 8/2000 | Braun |
| 6,182,398 | B1 | * | 2/2001 | Head |

* cited by examiner

*Primary Examiner*—Carl D. Friedman
*Assistant Examiner*—Kevin McDermott
(74) *Attorney, Agent, or Firm*—Cox & Smith Incorporated

(57) ABSTRACT

An air beam structure having reduced weight, increased rigidity, and lower inflation pressure requirements. The structure includes a closed tubular cylindrical shell of air impermeable fabric having at least one inflation valve. Fixed within the shell is an "I" beam envelope comprised of flexible, air impermeable walls sealed to the interior of the shell. The "I" beam envelope extends the length of the shell and defines at least four air chambers in communication with the inflation valve. A quantity of compressible material is dispersed throughout the interior of the "I" beam envelope. When subjected to compressive forces by pressurization of the air chambers, the material becomes rigid. The filled envelope is either vented to atmosphere or connected to a vacuum source. The air beam is used in groups and may be connected one to another by sheet materials to form a wall or roof structure.

10 Claims, 5 Drawing Sheets

AIR BEAM CONSTRUCTION USING DIFFERENTIAL PRESSURE CHAMBERS

BACKGROUND OF THE INVENTION

1. Field of the Invention

The present invention relates generally to light weight inflatable structures and the like. The present invention relates more specifically to structural members in the nature of air beams that may be utilized in group assemblies or arrays to configure a large inflatable structure, especially for the construction of light weight inflatable buildings and the like.

2. Description of the Related Art

There have been many efforts in the past to utilize inflatable elements in the construction of portable, light weight buildings, enclosures and the like. There are many benefits to be gained through the use of such light weight enclosures, including the ability to easily transport and quickly erect the structures. Transportability depends upon the structure being flexible, foldable, compact and light weight when in a deflated condition. Rapid set-up (inflation) depends upon limiting the volume of air that must be injected into the structure to provide sufficient size, shape and support.

Some efforts to provide light weight inflatable structures have focused on pressurizing the interior of the entire enclosure as with an inflated dome roof. This approach has a number of drawbacks that include the need for a base framework to hold and seal the edge of the structure to the ground or other surface on which the structure is erected. Perhaps the primary drawback to this approach is the need to provide a means for entry into and exit from the interior of the enclosure while maintaining the necessary inflation pressure. Typically this means maintaining an air pressure source that may constantly and automatically replenish the air within the enclosure.

More recent efforts to create inflatable structures have focused on utilizing closed "air beam" elements that, when inflated, provide a more or less fixed structural element. These air beams are typically tubular in cross section and are constructed of air impermeable fabrics. Often these air beams are shaped to establish the configuration of the enclosure upon inflation, such as with arch shaped tubes, each end of which may be fixed to the ground. An array of such tubes may be connected and joined with flat fabric elements that provide the wall and/or roof enclosure for the overall structure. Examples of some of these efforts include the following:

U.S. Pat. No. 6,108,980 issued to Braun on Aug. 29, 2000 entitled BUILDING ELEMENT, describes a structural design for light weight buildings and the like having cellular wall elements with alternating positive and negative pressure chambers. The objective of the positive and negative pressure chambers is to draw components of the structure together in a manner that restricts their movement with respect to each other.

U.S. Pat. No. 4,288,947 issued to Huang on Sep. 15, 1981 entitled MODULAR INFLATABLE DOME STRUCTURE, describes a modular dome structure that includes a number of rigid frame members in addition to the inflatable dome surface. Specialized Y-joints for connecting the rigid frame members are described. All inflatable members are designed to harden after inflation by vulcanization and curing.

U.S. Pat. No. 5,311,706 issued to Sallee on May 17, 1994 entitled INFLATABLE TRUSS FRAME, describes an inflatable truss frame according to a variety of different geometric embodiments. In each instance, the truss structure is defined by the specific geometry of the individual inflatable sections and the manner in which these components are themselves formed from Mylar sheeting and the like.

U.S. Pat. No. 5,677,023 issued to Brown on Oct. 14, 1997 entitled REINFORCED FABRIC INFLATABLE TUBE, describes an inflatable tube for use as a structural element that incorporates spiraling, high strength ribbons mounted on a fabric skin surrounding an inflatable bladder. Reinforcing ribbons are also positioned on the outside of the skin parallel to the axis of the tube to strengthen the tube against bending forces.

U.S. Pat. No. 5,735,083 issued to Brown et al. on Apr. 7, 1998 entitled BRAIDED AIRBEAM STRUCTURE, describes an air beam that includes a cylindrical external braid that is lined with an air impermeable bladder. The improved design described is resistant to buckling because of linear bundles of fibers that extend parallel to the axis of the cylindrical braid and within the cylindrical weave.

U.S. Pat. No. 4,146,996 issued to Arnesen on Apr. 3, 1979 entitled THERMO-VACUUM STRUCTURE, describes a building construction component that draws a partial vacuum from between a double layer of fabric. In this case, however, the partial vacuum is intended to act as a thermal barrier. In the process, however, the pressure differential supports the inner fabric layer and stresses the outer fabric layer in such a manner as to cause it to cling to a rigid form positioned between the layers.

U.S. Pat. No. 4,183,378 issued to Decker on Jan. 15, 1980 entitled LIGHT WEIGHT VACUUM MAINTAINED STRUCTURES, describes a light weight vacuum maintained structure intended for use in conjunction with an air ship or the like. The complex structure described includes an array of pressurized keystone shaped cells that cylindrically surround the interior of the structure within which a vacuum is drawn.

U.S. Pat. No. 5,579,609 issued to Sallee on Dec. 3, 1996 entitled RIGIDIZABLE INFLATABLE STRUCTURE, describes another version of a rigidizable dome-shaped inflatable structure that incorporates bundles of reinforcing fibers commingled with binder materials. The structure, after inflation, is rigidized by applying heat from an incorporated heat source.

U.S. Pat. No. 5,421,128 issued to Sharpless et al. on Jun. 6, 1995 entitled CURVED, INFLATED, TUBULAR BEAM, describes a curved, inflatable tubular beam whose strength is supplemented by a braided fiber shell and an array of external axial fibers. The angle of the braid helps determine the curvature of the inflated structure.

U.S. Pat. No. 5,546,707 issued to Caruso on Aug. 20, 1996 entitled POLYETHELENE INFLATABLE TUBE CONSTRUCTION DEVICE, describes an inflatable tube system incorporating discrete inflatable tube segments having terminal ends and a variety of mechanisms for the attachment of one segment to the other. A fabric covering of woven polyethylene material encloses the bladder to provide strength. Inflation air valves are positioned on end closures for the air bladder.

As indicated above, efforts to provide improved rigidity for air inflated structural components have focused primarily on external additions to the tubular air chambers that serve to strengthen the walls. Such external additions permit higher pressures (and thus greater rigidity) and directly add rigidity to the structural member once inflated. Unfortunately, all of these external additions to improve the structural integrity of the inflatable air beam add weight, complexity and expense to the portable buildings and enclosures constructed from these components. In addition, the move to higher pressures has resulted in an increased likelihood of explosive decompression as a result of fabric failure. Such unsafe ruptures continue to occur despite efforts to reinforce the outer shell of the tubular air chambers.

It would be desirable to have an air beam component that retained all of the benefits of typical air beam elements and added a rigidizing component to the air beam without greatly increasing the size, weight, complexity or cost of the air beam. It would be desirable if such a rigidizing component in an air beam could be easily implemented in conjunction with the inflation process and did not reduce the portability of the inflatable structure by decreasing the flexibility of the structure in an uninflated state. In other words, it would be desirable to have a rigidizing element that could alternately be made flexible or rigid depending upon the establishment or the removal of the structure.

SUMMARY OF THE INVENTION

It is therefore an object of the present invention to provide an air beam component that retains the benefits of typical light-weight air beam elements and adds a means for making the air beam rigid without greatly increasing the size, weight, complexity or cost of the air beam.

It is a further object of the present invention to provide a rigidizing component in an air beam element that is flexible prior to inflation of the air beam and becomes rigid subsequent to inflation.

It is a further object of the present invention to provide an air beam element with an incorporated rigidizing component that does not reduce the portability of an inflatable structure comprised of such air beam elements by decreasing the flexibility of the structure in an uninflated state.

It is the further object of the present invention to provide an improved hybrid air beam component comprising air pressure compartments and rigidizing components that eliminate the need for high pressure inflation and the resultant risk of explosive decompression.

In fulfillment of these and other objectives the present invention provides an air beam structure having reduced weight, increased rigidity, and lower inflation pressure requirements. The improved structure comprises a tubular cylindrical shell constructed from an air impermeable fabric closed at each end and having at least one inflation valve port. Fixed within the tubular cylindrical shell is a hollow "I" beam envelope comprised of a number of flexible, air impermeable walls that are sealed to the interior surface of the cylindrical shell. The hollow "I" beam envelope extends the length of the cylindrical tube and thereby defines at least four air chambers that are in air flow communication with the inflation valve port. The hollow "I" beam envelope likewise defines an interior longitudinal volume having an "I" shaped cross section that is isolated from the inflation air chambers. A quantity of micro bead particles or similar material is dispersed throughout the interior of the hollow "I" beam envelope which, when subjected to the compressive forces brought about by the pressurization of the air chambers, becomes rigidized in the two parallel and one orthogonal planes associated with the "I" beam cross section. The micro bead filled envelope is either vented to atmospheric pressure or connected to a vacuum source for establishing a differential pressure between the inside of the envelope and the air chambers exterior to the envelope. The improved air beam structure is utilized in groups or arrays that may be connected one to the other by fabric or sheet like materials to form a closed wall or roof type structure upon inflation. The method of use comprises inflating the air chambers within the air beam to establish the shape and size of the enclosure and then optionally subjecting the micro bead filled envelope to a vacuum source so as to create a pressure differential sufficient to compress and rigidize the micro beads enclosed therein.

DETAILED DESCRIPTION OF THE PREFERRED EMBODIMENTS

Figure 1A:
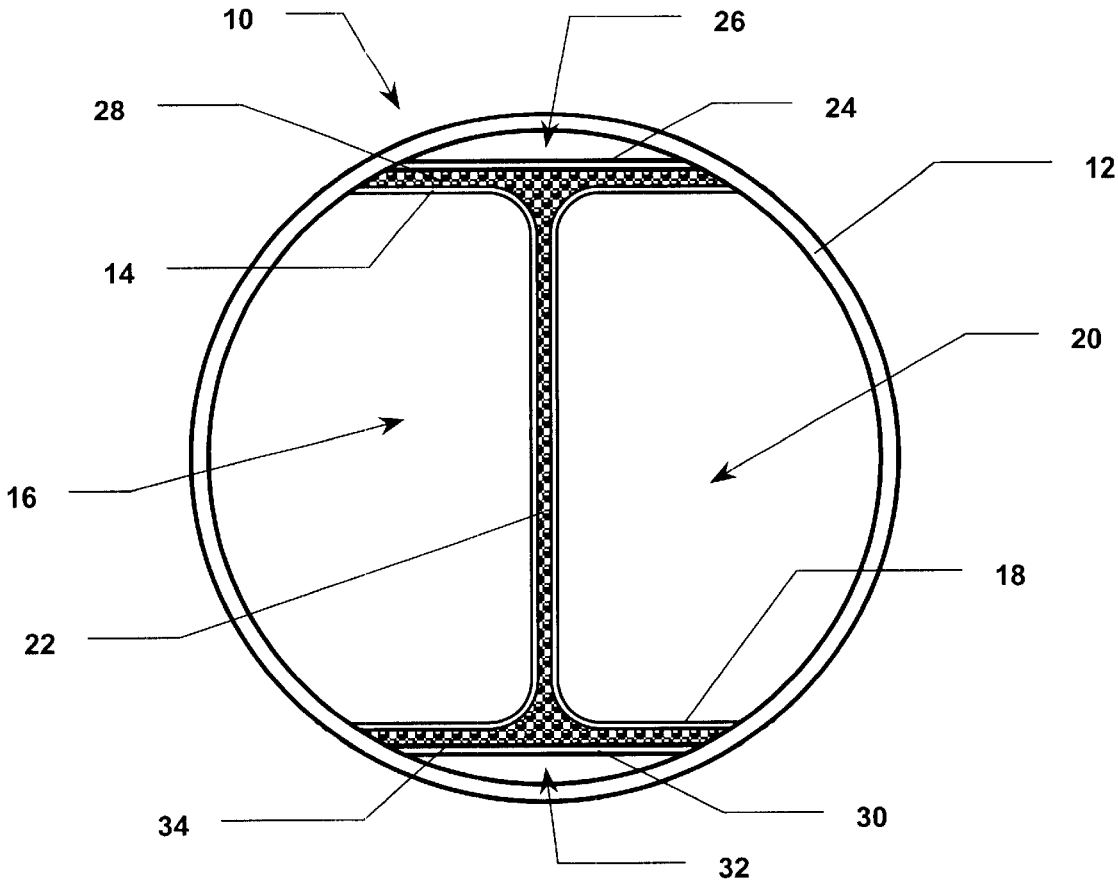
FIG. 1*a* is a cross sectional view of the structure of a first preferred embodiment of the present invention.

The present invention realizes the benefits of existing air beam construction and further realizes a structural rigidity not found in even high pressure inflatable members. The basic structure of the preferred embodiment of the present invention is disclosed in cross sectional detail in FIG. 1*a*. Air beam 10 is shown in cross section as it would appear at any point along the length of the beam apart from the physical ends of the beam where the tubular enclosure is closed. Air beam 10 is comprised of cylindrical shell 12 which, when under internal pressure, takes on a circular cross section. Cylindrical shell 12 in the preferred embodiment may be constructed of any of a number of known air impermeable fabrics. Typical examples of such fabrics seek to balance weight with structural strength. Because the present invention relies less on high pressure to instill rigidity to the air beam, it becomes less important for the fabric of cylindrical shell 12 to be of such strength (and therefore of such weight) to withstand very high internal pressures.

The internal structure of air beam 10 comprises what may generally be referred to as a hollow "I" beam construction. The hollow "I" beam structure is created by an arrangement of four air impermeable walls that in turn define four longitudinal chambers within cylindrical shell 12. First side wall 14 defines first side chamber 16 between the inner "I" beam construction and a section of cylindrical shell 12. First side wall 14 forms three of four sides of the nearly rectangular cross section of chamber 16. Second side wall 18 is a mirror image of first side wall 14 and is positioned opposite first side wall 14 within cylindrical shell 12. Second side wall 18 defines second side chamber 20. First and second side walls 14 and 18 share a common internal boundary along an approximate diameter of cylindrical shell 12 but are not sealed or bonded together. Instead an "open" volume is defined between the parallel sections of each side wall 14 and 18. The micro bead filling within this open volume that provides rigidity to the structure is described in more detail below.

Top wall 24 and base wall 30 complete the definition of the "I" beam configuration within cylindrical shell 12. Top wall 24 extends across and adjacent to a portion of both first and second side walls 14 and 18 as shown. In this manner a third longitudinal chamber, top chamber 26, is defined within cylindrical shell 12. Likewise, base wall 30 extends across and adjacent to a portion of both first and second side walls 14 and 18 as shown to define base chamber 32. As with the internal "open" volume created along the central meeting of first and second side walls 14 and 18, a similar pair of contiguous "open" volumes are created as the top and base of the internal, hollow, "I" beam construction.

It can be readily appreciated that each of the four wall structures described above, side walls 14 and 18, top wall 24, and base wall 30, is sealed along its edges to the inside surface of cylindrical shell 12. Although the view shown in FIG. 1*a* discloses a continuous cylindrical shell 12 and an array of discreet wall sections extending across and between points on this cylindrical shell, it will be readily appreciated that any of a number of different combinations of wall sections and cylindrical shell sections can be assembled to create the cross sectional structure shown. It may be more practical, as an example, to construct the tubular member by sealing various longitudinal components together along four longitudinal seams. These four seams might be formed at the points where the top wall or base wall meets the side walls and the cylindrical shell. Thus instead of there being a seal for a side wall against the cylindrical shell separate from an adjacent seal between the top wall (or base wall) and the cylindrical shell, these two seals may be combined into one longitudinal seal (for a total of four such sealed seams). The important result is simply the establishment and definition of four air chambers and a single "I" shaped "open" volume within the internal wall components.

While the four air chambers 16, 20, 26, and 32 remain "empty" so as to receive pressurized air as described in more detail below, the internal "I" shaped volume described above is filled with a quantity of micro bead particles or similar material. These micro beads, when compressed, serve to form a rigid structural member, that in the preferred embodiment takes on the cross sectional configuration of an "I" beam. It is known to use micro beads of a variety of sizes (0.25 mm to 5.00 mm is typical) and compositions for the purpose of vacuum forming a multi-layer material into a form fitting rigid shell. Such materials are sometimes used in conjunction with form fitting orthopedic casts and the like wherein a pre-shaped envelope of multi-layer polymer plastic sheeting is filled with a quantity of micro beads and then subjected to a vacuum. The reduced pressure between the layers causes a compressive force to be exerted (by atmospheric pressure) on the outside of the envelope against the micro beads held inside. This compressive force on the micro beads, confined by the air impermeable walls, results in a planar structure that is relatively rigid and resistant to bending, especially along lines that fall within the plane of the multi layer envelope.

A variety of different filler materials may be utilized in place of the micro beads described above. While small beads are utilized in orthopedic vacuum cast devices, they are but one of a number of appropriate materials suitable for use as a rigidizing element in the present invention. Alternate materials could include a quantity of rigid foam pieces of either regular or irregular geometric shape. These foam elements may be sized up to three to four inches in cross section depending upon the size of the enclosure. In addition, these filler pieces could be made with a coarse or fuzzy surface that would tend to partially lock together when the elements are compressed into close proximity. The key in selecting an appropriate filler material for the rigidizing element in the present invention is the ability of the material to readily move and shift when no compressive forces are placed on the envelope, and to resist movement and shifting when compressive forces are applied.

As indicated above, the most appropriate structure of the filler material is in part defined by the geometry and size of the air beam structure itself. While air beams, according to the present invention, can vary greatly in size, typical geometries could include tubular diameters anywhere from less than two inches to more than eighteen inches. Variations in diameter, of course, lead to scaled variations in the size of the internal components in the air beam of the present invention. The relative sizes of each of the components, however, are fairly consistent throughout a range of air beam diameters.

In the present invention, the "I" shaped volume defined by the wall sections described above is loosely filled with such micro beads which, when sufficiently compressed, form a rigid "I" beam structure. The compressive force necessary to rigidize the micro beads within the "I" beam envelope may be the result of establishing a negative pressure (with respect to atmospheric pressure) on the internal "I" shaped volume, establishing a positive pressure (with respect to atmospheric pressure) within the four longitudinal chambers that surround the "I" beam envelope, or both. The only requirement is that a negative pressure differential be established between the internal "I" shaped volume and the four air chambers that surround the "I" beam structure. The greater this pressure differential, the greater the rigidity of the internal micro bead filled structure.

It will be understood, and explored in more detail below, that the described pressure differential can be achieved by pressurizing the four air chambers and allowing the internal "I" shaped volume to be vented to atmospheric pressure. In doing so, not only is the general cylindrical shape to the air beam tube established, but the appropriate compressive forces are exerted on the micro bead envelope to provide the necessary rigidity to the structure. For the same reasons a metal "I" beam structure efficiently provides rigidity (resistance to bending forces) in two orthogonal planes, the "I" shaped cross section of the present invention provides the same resistance to "side to side" and "up and down" bending forces.

It is also understood that in some circumstances it is desirable to supplement the pressure differential (created by pressurizing the four chambers) by subjecting the internal "I" shaped volume to a negative pressure or vacuum source. As is explained in more detail below, it is anticipated that only drawing a vacuum on the internal micro bead volume would not provide an efficient and beneficial light weight beam structure.

The process for inflating and rigidizing the air beam of the present invention would typically occur in just that order, namely inflation followed by rigidizing. The process of inflating the four chambers, even under low pressure, serves to establish the shape of the air beam and the structure of the object (a building or the like) that the air beam in part defines. Absent excessive external forces (such as from wind, rain, snow, and other "weights" on the roof and walls of an inflatable building or the like) the inflated air beam will take on a shape that is defined by the geometry of its construction and the retention of the ends of the air beam in fixed positions on the ground or other support structure. Thereafter, resistance to bending movement caused by such external forces must be derived from either ever higher internal pressures (as with the prior art) or from the system of the present invention wherein internal rigidity is established by exerting compressive forces on orthogonal planes of multi layer envelopes of micro bead filled volumes.

Figure 1B:
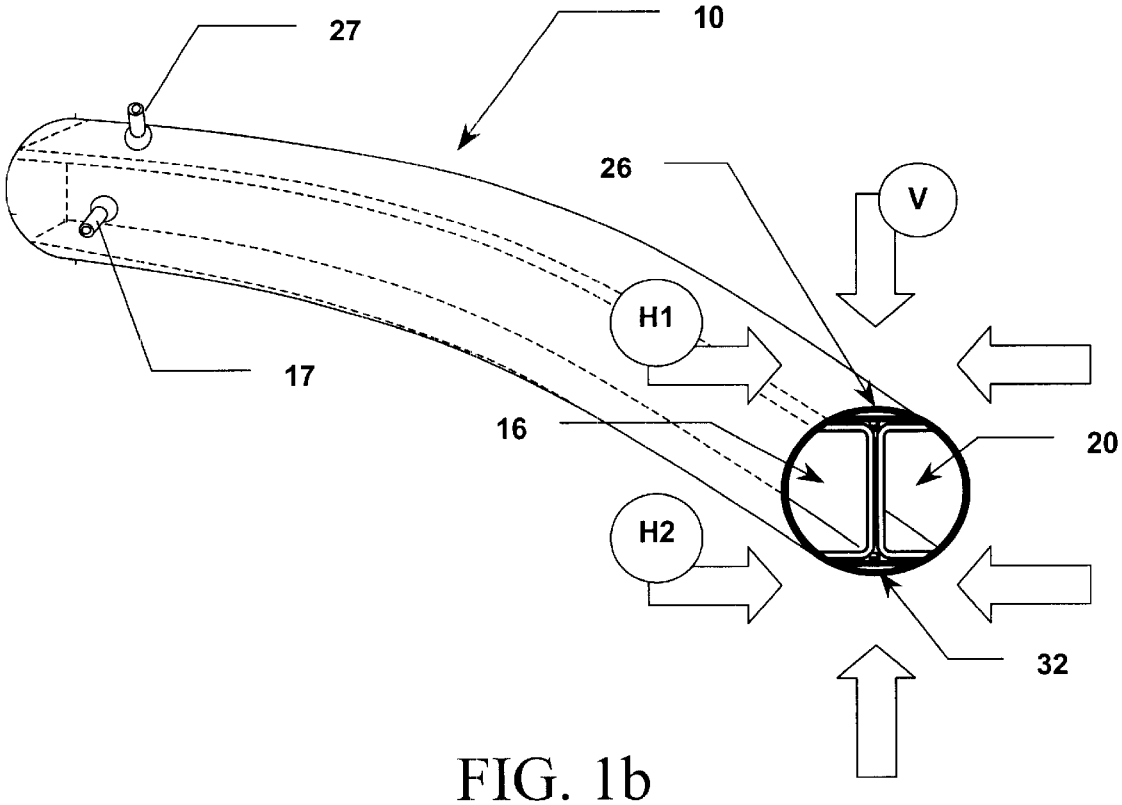
FIG. 1*b* is a perspective view of the structure of the embodiment of the present invention as disclosed in FIG. 1*a*.

FIG. 1*b* provides a perspective view of a section of an air beam 10 according to the first preferred embodiment shown in FIG. 1*a*. The four air chambers 16, 20, 26, and 32 are shown in cross section and (as dotted lines) in their extension along the length of the air beam. Positioned at one point along the length of air beam 10 are air inflation valves 17 and 27. In this instance, inflation valve 17 conducts air into chamber 16 while inflation valve 27 conducts air into chamber 26. Similar valves not shown in this view would conduct air into chambers 20 and 32 as appropriate. It should also be understood that appropriate internal communications ports between the above mentioned air chambers could eliminate the need for multiple inflation valves on a given section of air beam.

As indicated above, the pressure differential necessary to impart rigidity to the micro bead filled "I" beam enclosure may be accomplished by pressurizing the four air chambers and simply venting the internal "I" beam envelope to atmospheric pressure. Such venting to atmosphere may be accomplished by any of a number of mechanisms including a fixed port, a plurality of fixed ports, and/or a section of air permeable fabric along an external seam associated with the "I" beam envelope construction. The embodiment described above wherein the differential pressure is supplemented by subjecting the internal envelope to a vacuum may be accomplished by providing a valve structure similar to valves 17 and 27 shown in FIG. 1*b* that is in communication with the internal micro bead filled envelope. Appropriate positive pressure and vacuum connections could then be made for the inflation and rigidizing steps in the process of establishing the air beam element.

Also shown in FIG. 1*b* are the various bending forces that are resisted by the "I" beam structure of the internal rigidized envelope. The single rigid plane established diametrically across the cylindrical tubular structure of the air beam resists the "vertical" forces V shown in the figure. "Horizontal" forces H1 and H2 are likewise resisted by the two parallel planes established orthogonal to the diametrical plane mentioned above. In this manner the structure of the air beam of the present invention is established by the appropriate inflation of the air chambers and is made rigid by the establishment of the necessary compressive forces on an enclosed envelope of micro beads.

Figure 2:
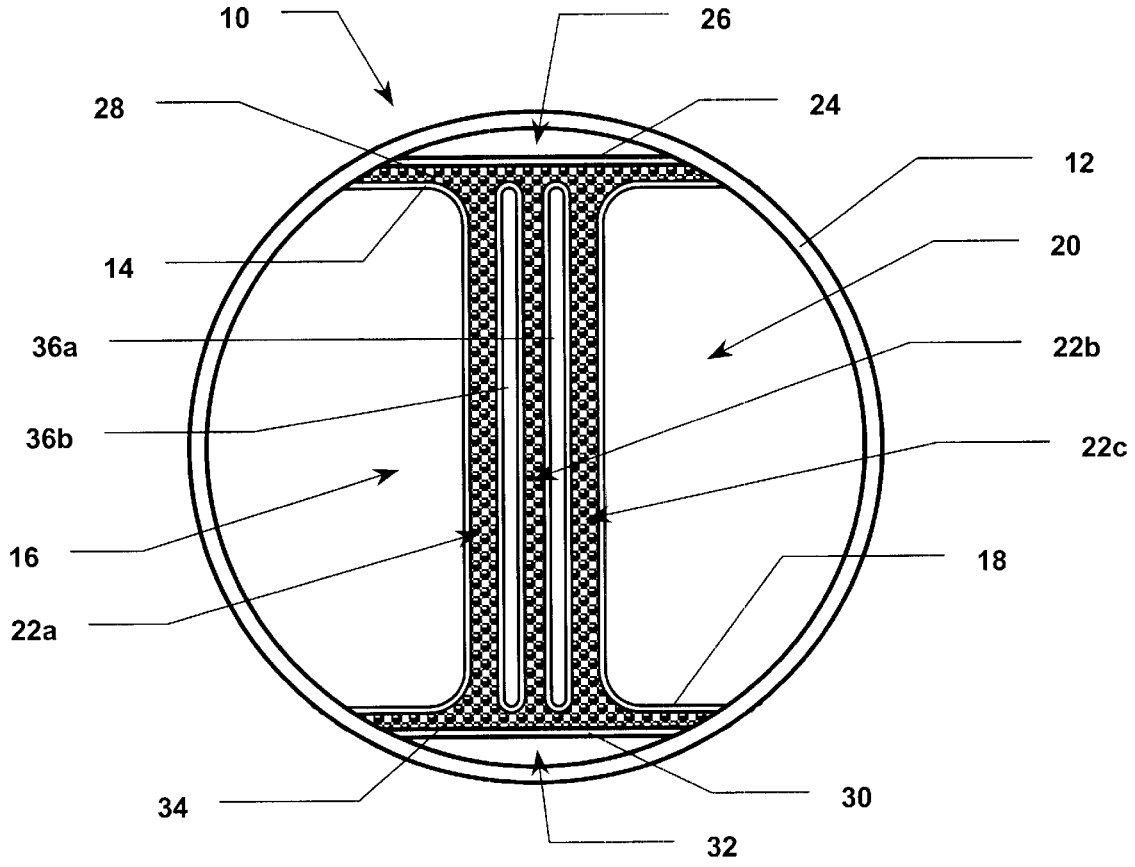
FIG. 2 is a cross sectional view of an alternate structure of the present invention.

FIG. 2 discloses an alternate preferred embodiment of the present invention that includes a modification of the internal, diametrically planar component of the "I" beam element. Instead of a single layer envelope for containing the micro beads the embodiment shown in FIG. 2 includes multiple, layered envelopes of micro beads positioned within a contiguous volume. Air beam 10 in FIG. 2 retains most of the same elements as the embodiment shown in FIG. 1*a*. The center portion of the "I" beam construction is comprised of first side wall 14 on one side and second side wall 18 on an opposing side. In between these two layers are multiple planar volumes 22*a*, 22*b*, and 22*c*. These additional micro bead filled volumes are defined by center walls 36*a* and 36*b* as shown. It is understood that additional (or fewer) center walls could be incorporated to further modify the design of this alternate preferred embodiment. The objective of the alternate structure shown in FIG. 2 is further rigidity within the center plane of the "I" beam. Just as laminate solid structures have increase bending resistance, so too does the resultant layered laminate structure of rigidized micro beads described herein. This embodiment also facilitates the even distribution of the micro beads within the envelope structure prior to compression of the micro bead filled volume. This is turn serves to reduce weak spots in the beam where thinning of the micro beads might otherwise have occurred.

Figure 3:
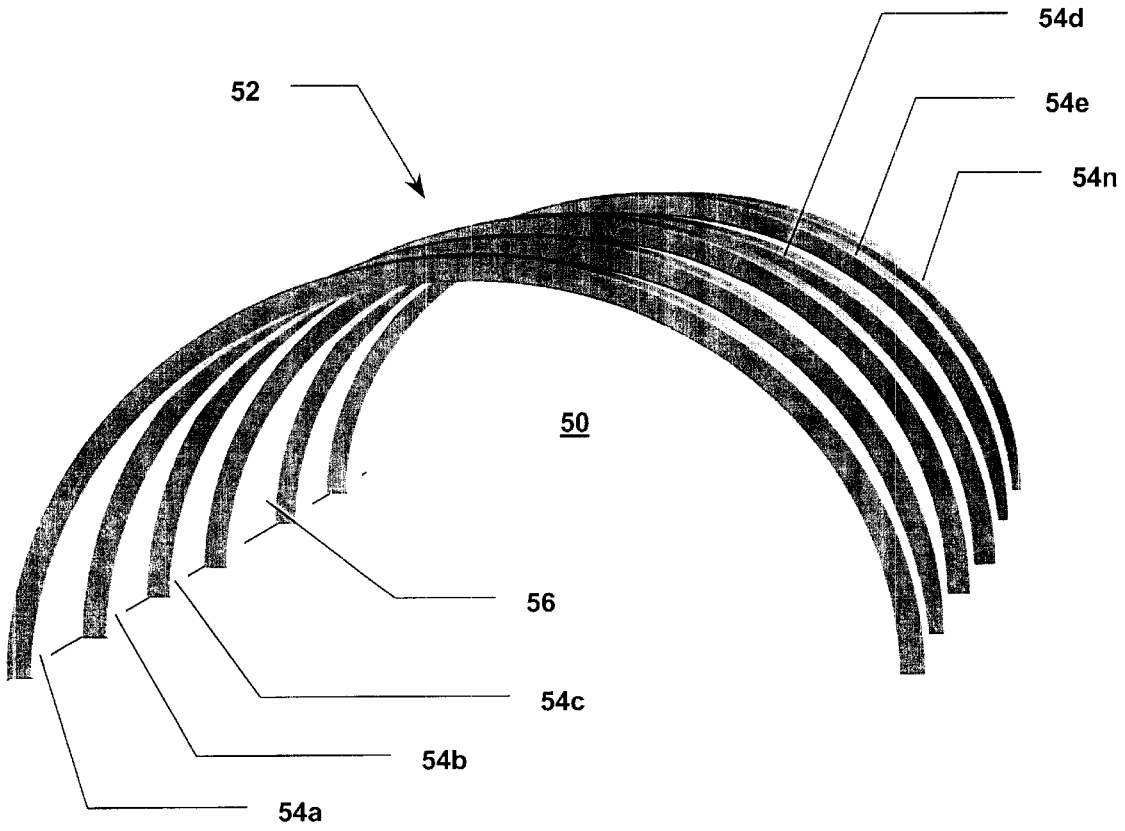
FIG. 3 is a perspective view of a typical assembly of a number of air beams of the present invention in the construction of a garage type building.

Reference is now made to FIG. 3 for a description of one application of the air beam element of the present invention in the building construction field. Building structure 52 in this perspective view is a simple garage type structure comprising a number of air beams linked together and fixed to the ground. A number of arch shaped air beams 54*a* through 54*n* are connected in parallel with a roof/wall fabric 56. Connecting fabric 56 may be adhesively sealed or sewn to each of the air beams to position them in parallel as indicated. Additional short sections of air beams (not shown) according to the present invention might be included between the arches in an orthogonal spacing orientation so as to separate and space the arches upon inflation.

Figure 4A:
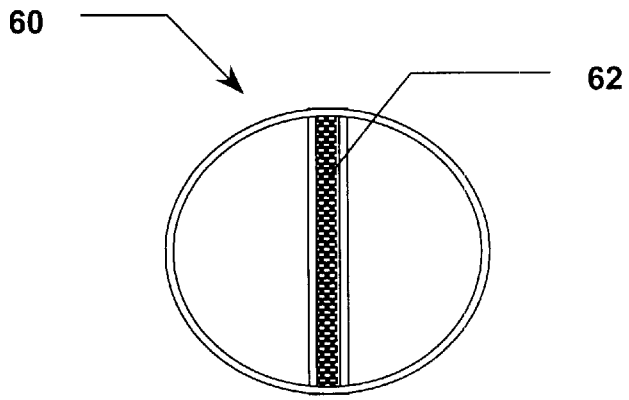
FIGS. 4*a*–4*c* are cross sectional views of various alternative structures of the present invention.
Figure 4B:
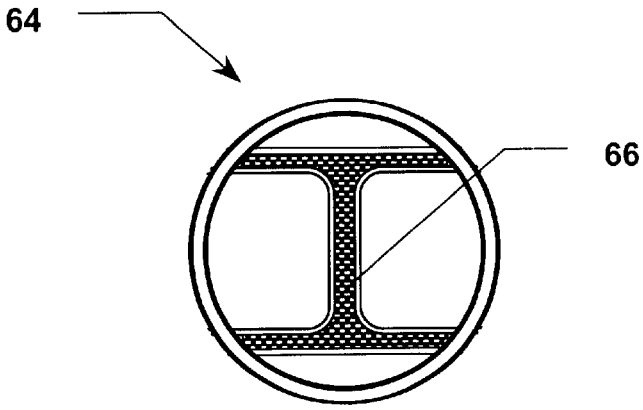
Figure 4C:
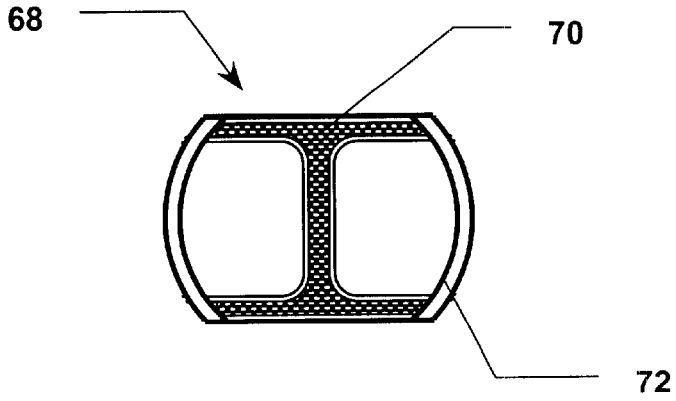

Finally, reference is made to FIGS. 4*a* through 4*c* for a brief description of further alternate internal structures for the air beam of the present invention. FIG. 4*a* discloses perhaps the simplest embodiment of the present invention wherein a single, diametrical wall 62 is established across the interior of the cylindrical air tube 60. It is recognized that this design, though simpler and less costly to manufacture, establishes a structural rigidity that lies primarily in a single plane coincident with wall 62. Thus the embodiment shown might be appropriate where little or no side to side bending forces are anticipated.

FIG. 4*b* is a slight modification of the design shown in FIG. 1*a*, still retaining the "I" beam cross section of the primary preferred embodiment. In FIG. 4*b* the top and base sections of the "I" shaped rigidizing envelope 66 are extended and the central (diametrical) section is shortened. This configuration significantly increases the side to side resistance to bending forces while still maintaining a resistance to up and down bending forces. Obviously the orientation of the cylindrical air beam 64 in this view (as well as that of each of the various embodiments described herein) has a significant effect on the directions of greatest resistance to bending forces. References to "side to side" and "up and down" bending forces are of course relative to the fixed orientation of the air beam when used in constructing an inflatable enclosure.

FIG. 4*c* provides a simple but no longer cylindrical structure to the improved air beam. In this design, air beam 68 is comprised solely of "I" beam envelope 70 and semi-cylindrical side walls 72. While this structure provides a somewhat desirable external shape (for the purposes of building construction and attachment of a fabric wall) it reduces the surface area of the rigidizing envelope that is subjected to the compressive forces brought about by inflation of the tube. In this embodiment, therefore, it might be desirable to subject the rigidizing envelope to a vacuum source to supplement the differential pressure.

Although the present invention has been described in conjunction with its implementation with specific applications, it is anticipated that the basic concepts of the invention translate into structures and geometries appropriate for implementation in a variety of applications. As indicated above, the present description has focused primarily on the application of the air beam structure to the establishment of portable buildings and the like. It is anticipated that those skilled in the art will readily define modifications of the invention appropriate for its implementation in other inflatable structure applications.

We claim:

1. A structural component for use in constructing inflatable enclosures, the structural component comprising:

a closed, inflatable, cylindrical shell having a length and a diameter, said shell comprising a flexible, air impermeable material forming a longitudinal tube, said cylindrical shell closed at a first and second end thereof;

a valve port positioned through said cylindrical shell for inflation thereof;

a rigidizing envelope positioned in association with said cylindrical shell and extending along said length thereof, said envelope comprising at least one air impermeable wall forming an enclosure; and a quantity of compressible material positioned within said enclosure of said rigidizing envelope, said material movable in the absence of compressive forces on said envelope and becoming immovable when compressive forces are exerted on said envelope.

2. The structural component of claim 1 wherein said quantity of compressible material comprises a quantity of micro beads.

3. The structural component of claim 1 wherein said quantity of compressible material comprises a quantity of rigid foam elements, said foam elements having average cross sectional diameters of less than four inches.

4. The structural component of claim 1 wherein said rigidizing envelope comprises at least two air impermeable walls forming an enclosure having an "I" shaped cross section.

5. The structural component of claim 1 wherein said rigidizing envelope comprises two air impermeable walls forming a planer enclosure extending diametrically across said cylindrical shell.

6. The structural component of claim 1 wherein said rigidizing envelope is positioned inside of said cylindrical shell and is fixed to an inside surface of said cylindrical shell.

7. The structural component of claim 1 wherein said rigidizing envelope is positioned external to said cylindrical shell and is fixed to an outside surface of said cylindrical shell.

8. The structural component of claim 1 wherein said rigidizing envelope further comprises a vent to external atmospheric pressure.

9. The structural component of claim 1 wherein said rigidizing envelope further comprises a valve port positioned through said at least one air impermeable wall for drawing a negative pressure within said rigidizing envelope enclosure.

10. The structural component of claim 1 wherein the air impermeable material of said cylindrical shell comprises a rubber bladder layer surrounded by an enclosing polyester woven fabric layer.

* * * * *